US007254246B2

(12) United States Patent
Jakob

(10) Patent No.: US 7,254,246 B2
(45) **Date of Patent: *Aug. 7, 2007**

(54) METHOD FOR ESTABLISHING A BINAURAL COMMUNICATION LINK AND BINAURAL HEARING DEVICES

(75) Inventor: Andreas Jakob, Hombrechtikon (CH)

(73) Assignee: Phonak AG, Stafa (CH)

( * ) Notice: Subject to any disclaimer, the term of this patent is extended or adjusted under 35 U.S.C. 154(b) by 300 days.

This patent is subject to a terminal disclaimer.

(21) Appl. No.: 10/054,479

(22) Filed: Jan. 22, 2002

(65) Prior Publication Data

US 2002/0131613 A1 Sep. 19, 2002

Related U.S. Application Data

(63) Continuation of application No. 09/804,848, filed on Mar. 13, 2001, now Pat. No. 7,181,032.

(51) Int. Cl.
*H04R 25/00* (2006.01)

(52) U.S. Cl. ..... 381/315; 381/312; 381/322

(58) Field of Classification Search ..... 381/312, 381/314, 315–318, 322–324, 326, 327–328, 381/151, 331, 370, 384; 600/25; 607/55–57, 607/59; 181/128–130; 343/718; 455/100, 455/93

See application file for complete search history.

(56) References Cited

U.S. PATENT DOCUMENTS

| | | | | |
|---|---|---|---|---|
| 4,025,964 A | | 5/1977 | Owens | |
| 5,757,932 A | | 5/1998 | Lindemann et al. | |
| 5,991,419 A | | 11/1999 | Brander | |
| 6,084,975 A | * | 7/2000 | Perkins | 381/326 |
| 6,118,882 A | * | 9/2000 | Haynes | 381/151 |
| 6,198,971 B1 | * | 3/2001 | Leysieffer | 607/55 |
| 6,211,799 B1 | * | 4/2001 | Post et al. | 455/100 |
| 6,223,018 B1 | * | 4/2001 | Fukumoto et al. | 455/41.1 |
| 6,597,320 B2 | * | 7/2003 | Maeda et al. | 343/718 |
| 6,754,472 B1 | * | 6/2004 | Williams et al. | 455/100 |

FOREIGN PATENT DOCUMENTS

| | | |
|---|---|---|
| EP | 289208 | 11/1988 |
| FR | 2728106 | 6/1996 |
| JP | 2000-353571 | 12/2000 |
| JP | 2001-320516 | 12/2000 |
| WO | 92/22107 | 12/1992 |
| WO | 97/05673 | 2/1997 |
| WO | 97/14268 | 4/1997 |
| WO | 00/00001 | 1/2000 |
| WO | WO 01/87014 A2 * | 11/2001 |

* cited by examiner

*Primary Examiner*—Suhan Ni
(74) *Attorney, Agent, or Firm*—Pearne & Gordon LLP

(57) ABSTRACT

A binaural communication link between two hearing devices is established via at least one wire ($7_w$) and a conductor, which is formed by individual's body ($7_B$).

33 Claims, 4 Drawing Sheets

METHOD FOR ESTABLISHING A BINAURAL COMMUNICATION LINK AND BINAURAL HEARING DEVICES

BACKGROUND OF THE INVENTION

The present invention is directed on linking a pair of hearing devices to form a set of binaural hearing devices. Such hearing devices may be therapeutic hearing aid devices for hearing impaired persons or may be hearing devices just for improving human hearing or for allowing listening to electronically converted audio signals as e.g. for telephone ear-sets, ear-sets in airplanes or even noise protection hearing devices, thereby possibly for active noise cancellation.

Today known binaural links between a pair of hearing devices are impaired by the severe requirements at hearing devices and thereby especially at hearing aid devices with respect to electric power consumption. There has been proposed to establish such a binaural wireless communication link in the RF-frequency band or even in the microwave frequency band. Thereby satisfyingly small receiving and transmission aerials may be used, but the power consumption for the transmitter and the receiver is considerable.

A communication link approach at lower transmission frequencies necessitates, whenever audio signals shall be transmitted via such link, relatively complex encoding and decoding procedures as e.g. MPEG-codec, so as to result in high compression of the data being transmitted. Such encoding procedures nevertheless have the drawback of significant signal delay normally in excess of 50 msec and are therefore not suited for binaural communication between hearing devices as here a real-time signal processing is important.

Other approaches to such binaural communication are based on wire-bound transmission. This necessitates the appliance of at least two wires by mini plugs to both hearing devices of the pair. Handling of a cable with two wires and especially of respective mini-plugs at the hearing devices is cumbersome for the individual, especially if such handling is performed as the hearing devices are already applied to the individual's ear. Therefore it is an object of the present invention to propose a binaural communication link which eliminates the drawbacks mentioned of wire-based links.

SUMMARY OF THE INVENTION

This object is resolved by the present invention by an approach as it is disclosed in the WO 01/39569 of the same applicant and inventors and which accords to the U.S. patent application Ser. No. 09/804 848.

Therein the solution of the above outlined problem is disclosed. According to the present invention there is thus proposed a method of establishing a binaural communication link between two hearing devices at an individual by at least two electric conductors in that one conductor is established by the individual's body and the at least one second conductor by a wire.

Thus the individual body with the respective body impedance is exploited as one of the said conductors so that there remains, in minimum, a single wire connection to be established between the hearing devices. Such a single wire connection may very easily be handled and plugged in at the respective hearing devices by the individual.

By such a communication link either control signals to and from the respective hearing devices, but audio signals too, be it in analogue or in digital form, may be transmitted even bidirectionally. In a preferred embodiment there is thus proposed to bidirectionally transmit electrical signals between the hearing devices which are linked by the communication link according to the invention.

In a further preferred embodiment of the inventive method the hearing devices are not directly mutually linked by the said wire, but there is provided an electronic unit interconnected between the hearing devices by the communication link.

In a further preferred embodiment the electronic unit interconnected between the two hearing devices by the communication link according to the present invention comprises a receiver-/transmitter unit for wireless communication. Thereby signals received by wireless communication at such a unit are converted into signals which are transmitted via the said communication link with body-conductor to the hearing devices and/or by such an electronic unit signals received from the said two hearing devices by the said communication link with body-conductor are converted into wirelessly transmitted signals. Thus such an electronic unit operates as a wireless receiver-/transmit-unit to a remote transmitter-/receiver-unit by wireless communication for control signal transmission and/or for audio signal transmission. Such an electronic unit may be any RF-link as e.g. a Blue-tooth unit. Thereby the said receiver-/transmitter unit may be applied, in one embodiment to one of the hearing devices which is operated as a master device, the second hearing device as a slave. In an other more preferred embodiment, the receiver-/transmitter unit is provided between the two hearing devices, which are thus operated on equal level of control.

In a most preferred embodiment the advantage of having only one wire to be connected either directly between the hearing devices or from the respective hearing devices to an interconnected electronic unit is exploited by realising connection of the wire to the hearing devices and/or to such electronic unit by a magnetic attraction. This leads to most easily handable plugging. The wire with a respective magnetic plug at one or at both of its ends may just be brought adjacent to the respective plug area at the hearing device or at the electronic unit, Connection will be practically automatically installed by that wire end being magnetically pulled onto said plug area at the respective device.

Thereby and in one preferred embodiment, by said magnetic attraction there is installed a conductive contact of the wire to an input tab at the at least one hearing device. Under a "conductive" material we understand a material with ohmic current conductance. Thereby such conductive electric contact may be realised by at least one magnetic member or ferro-magnetic member itself which provides for plugging magnetic attraction too.

In a further preferred mode where for instance electroconductivity of a magnetic member or of a ferromagnetic member does not suffice for satisfying signal transmission, a conductive contacting is realised by the magnetic attraction—possibly additionally by a magnetic or ferromagnetic member—by at least one non-magnetic, metallic contact member, e.g. of aluminum, of copper, silver, gold, or of stainless steel or copper coated with gold and/or by conductive polymer.

In a further preferred mode said at least one wire is applied to at least one of the hearing devices and/or the electronic unit—mechanically—by magnetic attraction and—electrically —via a dielectric layer. Thereby a capacitive coupling is realised. By applying the wire to the at least one hearing device and/or electronic unit at both sides of the dielectric layer a conductive capacitance plate as e.g. of metal is established, thereby completing a capacitor structure. It is also possible to provide on both sides namely on the side of the hearing device or of the electronic unit, if provided, as well as on the side of the wire a dielectric layer. When such layers are joint once the connection is established, they form a dielectric double-layer. With provision of such dielectric layer or layers cleanability of the contact area is significantly improved e.g. on the side of the hearing device, where the dielectric layer may be part and be flush with the outer surface of the device's shell.

Because by the method of binaural linking according to the present invention only AC signals within a frequency band above 10 KHz are preferably to be transmitted, thereby especially digital signals, it is of no problem to transmit such signals via a series capacitance. Even if digital signals are thereby distorted they may easily be recovered by respective signal processing.

In a further preferred mode where the connection of the wire to at least one of the hearing devices and/or to the electronic unit, if provided, is established by magnetic attraction, this magnetic attraction is additionally exploited to provide for self-positioning of the wire's contact area to the hearing device and/or to the unit.

Thereby it becomes not even necessary that the individual manually and accurately positions the wire's contact area to the respective contact area of the hearing device or electronic unit, magnetic attraction suffices to mutually attract such areas and to accurately pull the areas into mutual correct positioning.

If necessary, by respective selection of polarities of magnets, on one hand on the hearing device or electronic unit, and, on the other hand, on the side of the wire, one can prevent that the wrong wire side is applied to a respective hearing device or electronic unit contact area.

If there is provided, as mentioned above, an electronic unit interconnected and communicating with the said two hearing devices by the communication link according to the present invention, such electronic unit has preferably a body contact electrode.

Such body contact electrode may be conductive, preferably at lest one of metallic and of a conductive polymer, or may be capacitive.

In a further preferred mode of realising the method according to the present invention the two hearing devices are in-the-ear or outside-the-ear hearing devices, and/or are hearing aid devices for therapeutic appliances.

In a still further preferred mode of the inventive method the wire connection and, if provided, also an electronic unit to be interconnected between the hearing devices is integrated within a head-worn assembly, thereby preferably within glasses for the individual. By such assembly, especially by glasses an accurate positioning of the wire connection is established without being even visually recognisable for other persons. In the above mentioned embodiment, especially where electric connection of the glasses-integrated wire is realised by magnetic attraction to the respective hearing devices, electric contact from the glasses-integrated wire may be established just by putting on the glasses. An interconnected electronic unit even for wireless communication with a remote transmitter-/receiver unit may also be integrated into the glasses with a respective transmission aerial.

The present invention is now to be described with the help of figures, which exemplify preferred embodiments of the method for establishing binaural communication links and of binaural hearing devices according to the present invention. The WO 01/39569 shall be incorporated into the present description by reference.

DETAILED DESCRIPTION OF THE INVENTION

Figure 1:
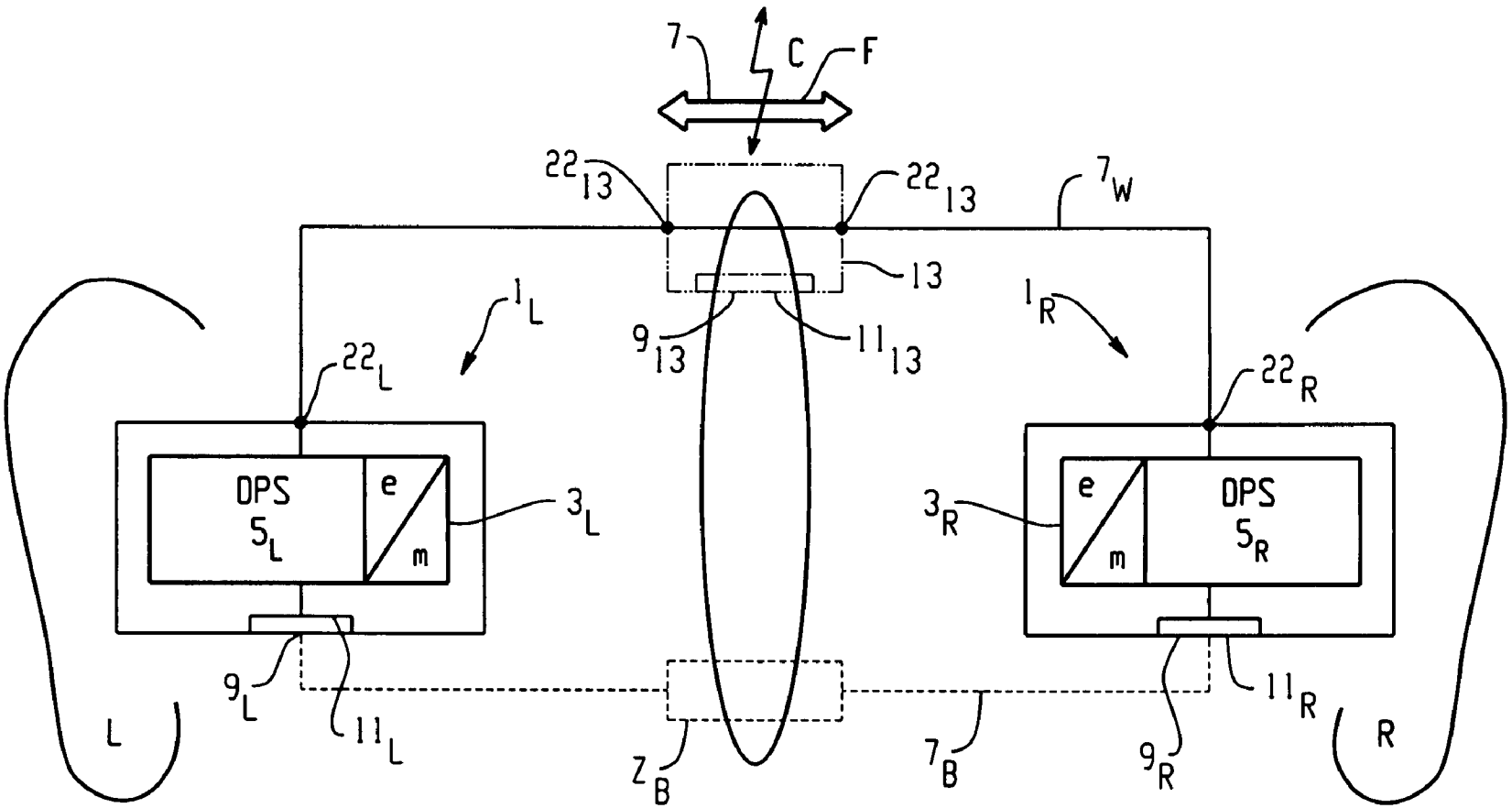
FIG. 1 schematically, the principle of the method of establishing a binaural communication link between hearing devices according to the present invention and, accordingly, of a binaural hearing device set according to the present invention.

In FIG. 1 there is shown, in a most generic and simplified representation form, the principle of the method according to the present invention and, accordingly, a set of binaurally operated hearing devices. At the left side -L- and the right side -R- ear of an individual there is applied a left-ear hearing device $\mathbf{1}_L$ and respectively a right-ear device $\mathbf{1}_R$. Conceived as active hearing devices, each of these devices comprises an electrical to mechanical converter $\mathbf{3}_L$ and $\mathbf{3}_R$ being e.g. respective loudspeakers. These converters $\mathbf{3}_{L,R}$ are operated by respective electronic units $\mathbf{5}_L$ and $\mathbf{5}_R$, which comprise, for digital hearing devices, customarily a digital processing unit DSP. There is further provided a communication link between the two hearing devices $\mathbf{1}_L$ and $\mathbf{1}_R$ schematically denoted in FIG. 1 by the reference No. 7. This communication link is wire-bound and therefore comprises at least two wires, which link the two hearing devices $\mathbf{1}_L$ and $\mathbf{1}_R$ and thereby especially their electronic units $\mathbf{5}_L$ and $\mathbf{5}_R$.

According to the present invention one of these at least two wires forming the communication link 7 between the two hearing devices $\mathbf{1}_L$ and $\mathbf{1}_R$ is formed by a body conductor $\mathbf{7}_B$, which is realized by the individual's body between a contact area $\mathbf{9}_L$, whereat a body electrode $\mathbf{11}_L$ at hearing device $\mathbf{1}_L$ contacts the individual's body and a contact area $\mathbf{9}_R$, whereat a body electrode $\mathbf{11}_R$ at the hearing device $\mathbf{1}_R$ contacts individual's body. The body conductor $\mathbf{7}_B$ is shown in FIG. 1 in dashed lines with the impedance $Z_B$ representing the individuals body impedance between the said two contact areas $\mathbf{9}_L$ and $\mathbf{9}_R$. Besides of this body conductor $\mathbf{7}_B$ there is provided at least one wire conductor $\mathbf{7}_W$ completing the communication link 7. Clearly more than one communication link 7 may, if necessary, be provided between the hearing devices $\mathbf{1}_L$ and $\mathbf{1}_R$, which leads to multiple wire conductors $\mathbf{7}_W$ with commonly a body conductor $\mathbf{7}_B$.

As will be shown by examples, the communication link 7 may be operated to perform communication in a selected direction, e.g. from left to right, or and preferably to perform communication bidirectionally as shown in FIG. 1 by the double-arrow F.

Further, the communication via the communication link 7 according to the present invention may be for audio signals converted into a respective electronic form, especially into digital form, and/or for control signals for the respective electronic units $\mathbf{5}_L$ and $\mathbf{5}_R$. Thereby the communication link 7 may be established by providing the wire connector $\mathbf{7}_W$ directly interconnecting the two hearing devices $\mathbf{1}_L$ and $\mathbf{1}_R$, at another preferred mode of realizing the present invention there may be provided a further electronic unit as shown in dashed pointed lines in FIG. 1 and denoted by the reference No. 13 being interconnected between the hearing devices $\mathbf{1}_L$ and $\mathbf{1}_R$ and being electrically connected to at least one, preferably to both hearing devices $\mathbf{1}_L$ and $\mathbf{1}_R$ respectively with at least one wire connector. An electronic unit is further connected by a further body contact electrode $\mathbf{11}_{13}$ to the individual's body at a contact area $\mathbf{9}_{13}$.

Thereby the electronic unit 13 may comprise (not shown) a transmitter/receiver unit for wireless communication C with a remote receiver/transmitter unit (not shown) so as to receive in wireless communication audio signals and/or control signals to be transmitted to the hearing devices $\mathbf{1}_L$ and/or $\mathbf{1}_R$. Additionally or alternatively such transmitter/receiver unit at the electronic unit 13 may communicate control signals from and/or towards at least one of the hearing devices $\mathbf{1}_L$ and $\mathbf{1}_R$ towards and/or from a remote control unit. The electronic unit 13 may thus be conceived as any RF-link, e.g. as a Blue-tooth device.

Figure 2:
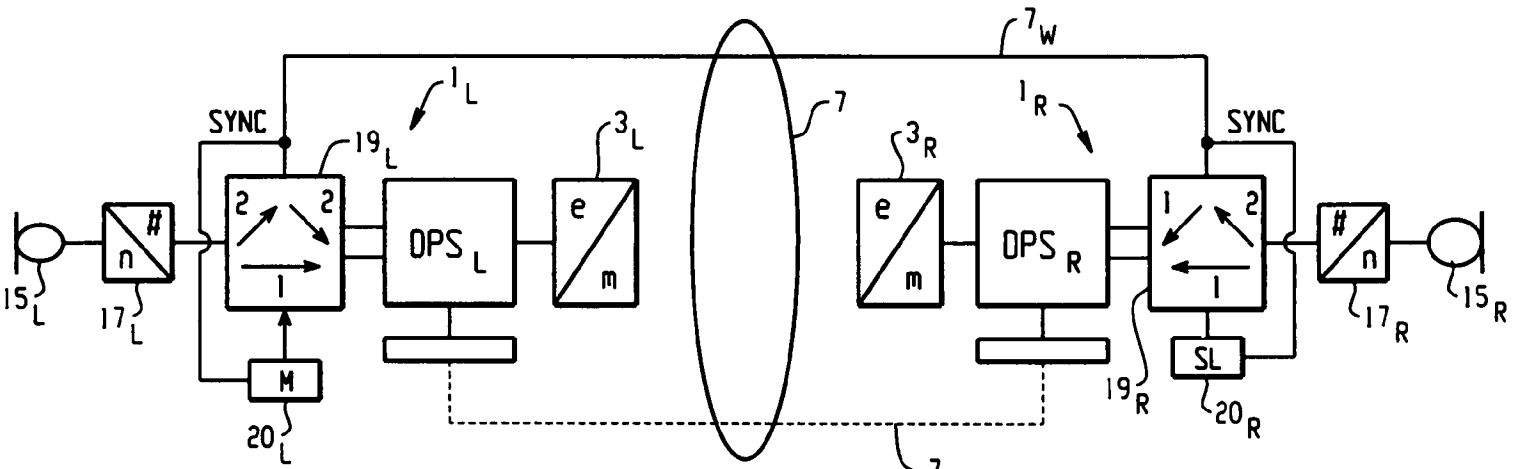
FIG. 2 schematically and simplified, a set of binaural hearing devices according to a preferred form of the present invention and operating according to the method of the present invention, thereby establishing bidirectional audio signal and/or control signal communication.

In FIG. 2 there is shown one specific embodiment of binaurally operated hearing devices with a communication link 7 according to the present invention. The two hearing devices $\mathbf{1}_R$ and $\mathbf{1}_L$ concomitantly operate for specific beam forming.

It is known that by providing microphones at a predetermined mutual distance and respective treating of the electric output signals of such microphones, beam forming may be achieved based on the fact of mutual phase difference or time lag with which an acoustical signal from an acoustical source impinges upon the two microphones. Such a beam forming is e.g. the well-known "delay and add" method According to FIG. 2 both hearing devices have respective microphones $\mathbf{15}_L$ and $\mathbf{15}_R$, the outputs thereof being operationally connected to respective analogue to digital converters $\mathbf{17}_L$ and $\mathbf{17}_R$.

At each of the hearing devices there is further provided, as schematically shown with the units $\mathbf{19}_L$ and $\mathbf{19}_R$, a controlled time-multiplexer unit, which is operated by a respective time control unit $\mathbf{20}_L$ and $\mathbf{20}_R$ in synchronism. As schematically shown in FIG. 2 in one first time frame '1' a digitalized output signal of microphone $\mathbf{15}_L$ is led, as an audio signal, via communication link 7 to the input of digital processing unit $DSP_R$ simultaneously with a digitalized output signal of microphone $\mathbf{15}_R$. Vice versa, in a second time frame '2' the digitalized output signal of microphone $\mathbf{15}_R$ is led to the input of digital processing unit $DSP_L$ altogether with the digitalized output signal of microphone $\mathbf{15}_L$. Thereby, staggered in timer the digital processing units DSP of both hearing devices receive at their respective inputs digitalized audio signals of both microphones. Synchronising of the time control units $\mathbf{20}_L$ and $\mathbf{20}_R$ is also performed via the communication link according to the present invention.

Due to the fact that both digital processing units DSP receive audio information of both microphones, both may perform beam forming.

Thereby, it becomes evident that it is absolutely possible to only provide one of the two digital processing units $DSP_L$ or $DSP_R$ with digitalized audio signals of both microphones and thereby to perform beam forming only at one of the two hearing devices $\mathbf{1}_L$ or $\mathbf{1}_R$. In such case digitalized audio signals may be one-directionally led via the communication link 7 according to the present invention from one hearing device to the other.

One of the two hearing devices acts in such a case as the beam forming hearing device, which may be said with respect to beam forming to act as a master hearing device, with respect to the second hearing device acting as a slave hearing device.

Figure 3:
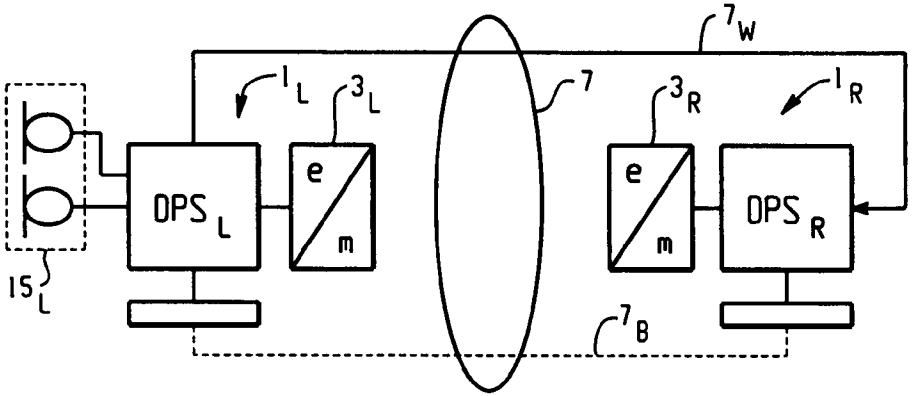
FIG. 3 in a representation form in analogy to that of FIG. 2 a set of binaural hearing devices according to the present invention and operating according to the method of the present invention, whereat one of the hearing devices is operated as a master device, the other as a slave.

In FIG. 3 there is shown a further preferred embodiment of a set of binaurally operated hearing devices communicating by the communication link 7 according to the present invention. Thereby this embodiment shows an example of one hearing device, namely device $\mathbf{1}_L$ acting as a master with respect to the second hearing device $\mathbf{1}_R$ acting as a slave. According to FIG. 3 only the hearing device $\mathbf{1}_L$ has a microphone or microphone arrangement $\mathbf{15}_L$. Beam forming is performed after audio signal digitalisation (not shown in FIG. 3) at the digital processing unit $DSP_L$. Via the communication link 7 according to the present invention, a digitalized audio signal is communicated via link 7 to the second hearing device $\mathbf{1}_R$ with appropriate phasing e.g. according to the mutual distance of the two hearing devices $\mathbf{1}_L$ and $\mathbf{1}_R$ at the individual, and this digitalized audio signal is directly electrically input to the digital processing unit $DSP_R$ of the hearing device $\mathbf{1}_R$. Thus, hearing device $\mathbf{1}_L$ acts as master hearing device with respect to a slave hearing device $\mathbf{1}_R$.

It is evident that further master/slave concepts via the communication link 7 according to the present invention may be realized also for control signals, one of the two hearing devices receiving e.g. by wireless communication control signals and transmitting control signals to the slave hearing device. In inverse direction acknowledgement signals, also being considered as control signals, may be retransmitted from the slave hearing device to the master hearing device.

Departing from the main object of the present invention the communication link 7 according to the present invention has the tremendous advantage of necessitating only one wire interconnecting, according to FIG. 1, either directly or via a further electronic unit 13, the two hearing devices $\mathbf{1}_L$ and $\mathbf{1}_R$. Thus, only one wire must be plugged to at least one of the two hearing devices $\mathbf{1}_L$ and $\mathbf{1}_R$ according to FIG. 1, at tap $\mathbf{22}_L$ and/or at tap $\mathbf{22}_R$. Although and with respect to handling plugging-in a hearing device communication link cable at one or at both of the hearing devices, it is evident that plugging-in one wire cable is already significantly easier than plugging-in a multiple wire cable, a further improvement thereabout is reached by providing, as will now be exemplified, plugging-in of the one-wire conductor at at least one or, preferably, at both hearing devices by magnetic attraction.

Figure 4:
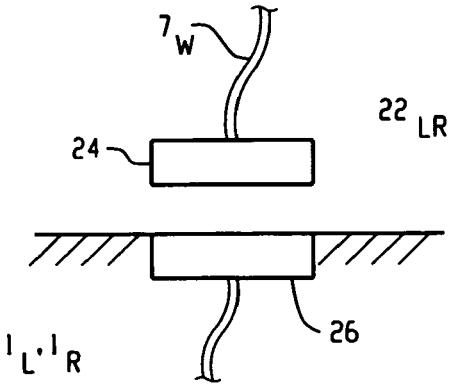
FIG. 4 in a simplified representation of a preferred plugging system for establishing to a wire part of the binaural communication link according to the present invention electric contact by magnetic attraction to a counterpart.

FIG. 4 schematically shows a plugging area $\mathbf{22}_{LR}$ according to FIG. 1. If an electronic unit 13 is provided, such plugging-in system may also be provided to contact unit 13 as is shown in FIG. 1 at $\mathbf{22}_{13}$ by the communication link wires $\mathbf{7}_W$.

Thereby at least one end of wire $\mathbf{7}_W$ and/or the respective contact area at one or both of the hearing devices $\mathbf{1}_L$, $\mathbf{1}_R$ and/or at unit 13 are provided with a magnet arrangement. According to FIG. 4 and as an example the end of the wire $7_W$ is provided with a magnet arrangement 24. The counterpart mechanical contact pad 26 may thereby be of ferromagnetic material or may be as well a magnet arrangement.

Thereby, mechanically, the end of wire $7_W$ needs only to be brought adjacent to the mechanical contact area 26 to be attracted and positioned in intimate contact therewith by permanent magnet action.

Nevertheless, this contacting by magnet/magnet contact or by magnet/ferromagnetic material contact needs not directly establish the electric contact. In some instances electro-conductivity and mutual contacting of magnet/magnet or magnet/ferromagnetic material contacts may not suffice for electric communication purposes.

Figure 5:
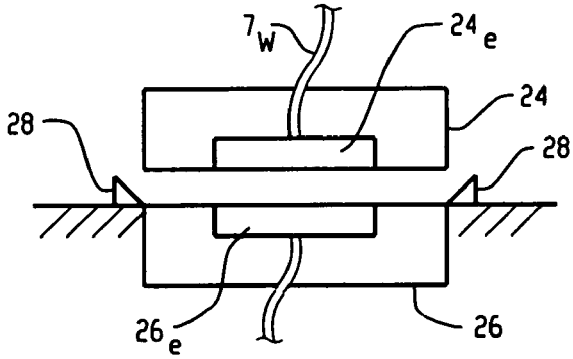
FIG. 5 in a representation according to that of FIG. 4 a further preferred plugging system.

An accordingly conceived plug-in arrangement is shown in FIG. 5 in the same schematic representation form as that of FIG. 3. The difference to the embodiment of FIG. 4 is that the magnetic arrangements and counterparts 24/26 are only provided for mechanical attraction purposes, whereas electric contacting of the wire $7_W$ to the hearing device or, respectively, the electronic unit 13 is performed by non-magnetic contact pads $24_e$ and $26_e$, e.g. of aluminum, copper, gold or of stainless steel or copper coated with gold and/or by a conductive polymer member.

So as to further improve ease of plugging-in the wire conductor $7_W$ making part of the communication link 7 according to the present invention and by magnetic attraction, there may be installed automatic self-positioning of the contact pads 24*e*, 26*e* as shown in FIG. 5 e.g. by providing guidance surfaces 28 so as to properly and automatically position the wire end contact 24, $24_e$. This might especially be important in the case where, according to FIG. 5 a pair of locally distinct electric contact pads $24_e$ and $26_e$ is provided having to be properly mutually positioned one upon the other. As will now be shown with the help of FIG. 6, electrical signal transmission from the wire $7_W$ to at least one of the hearing devices $1_L$ and $1_R$ and possibly even to the electronic unit 13 as of FIG. 1 and/or from the respective unit (hearing devices and/or unit 13) to individual's body via the contact area 9 as of FIG. 1 needs not necessarily be established by a conductive contact e.g. by a metallic/metallic or metallic/electrolytic contact (in case of body electrodes), but may be established capacitively, especially for transmitting digital signals representing audio signals or being control signals.

Figure 6:
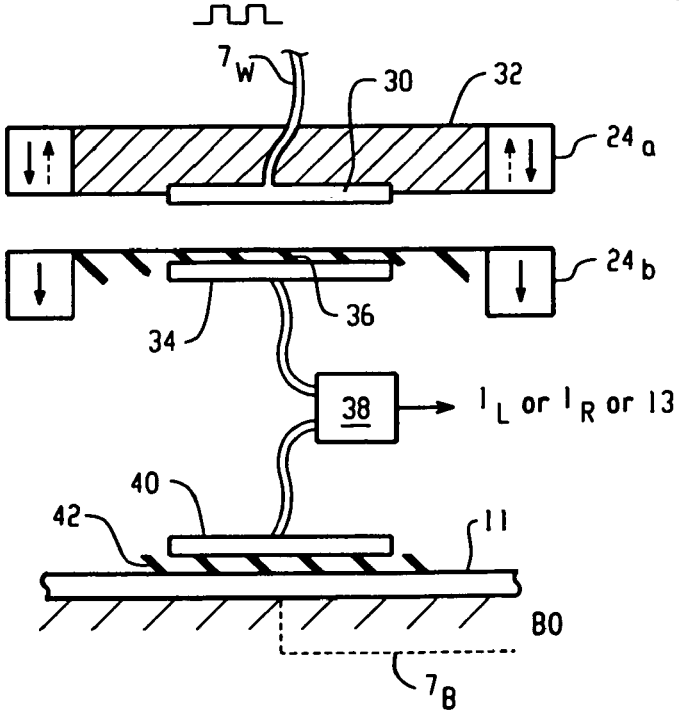
FIG. 6 in a schematic form a further preferred wire-contacting and/or body-contacting arrangement applied for establishing the communication link according to the present invention, and FIG. 7 glasses with integrated communication link according to the present invention.

According to FIG. 6 one end of the wire $7_W$ making part of the communication link according to the present invention is formed by a conductive plate as by a metal or conductive polymer layer 30 embedded in an isolating plugging arrangement 32 as schematically shown. On the opposite side, thus be it on one or both of the hearing devices or on the electronic unit 13, there is provided a second conductive plate as by a metal or conductive polymer layer 34, which is covered towards the outside by dielectric material, e.g. by a layer 36 of dielectric material. This layer may be unitarily formed the shell or housing of the hearing device considered or of the electronic unit 13. By bringing the conductive plate 30 in intimate contact with the surface of the dielectric layer 36, conductive plate or layer 30, dielectric layer 36 and conductive plate or layer 34 form or establish a capacitor in series with wire $7_W$ and operationally connected, as schematically shown, e.g. to a preamplifier stage 38 at the hearing device or at the unit 13. Especially for transmitting digital signals, even if such digital signals are distorted by the capacitive—30/36/34—electric link, it is of no problem to recover the digital signal e.g. at the preamplifier stage 38.

As further shown in FIG. 6 additionally or instead of capacitively coupling the wire $7_W$ to the electronic unit at unit 13 and/or to at least one of the hearing devices $1_L$, $1_R$ also the respective body contact electrode as of 11 of FIG. 1 may be conceived as a series capacitance electrode. Thereby, at electronic unit 13 or at at least one of the hearing devices $1_L$, $1_R$ the body contact electrode comprises a conductive plate as a metallic layer or a layer of conductive polymer 40 electrically connected to the respective electronic unit, as according to FIG. 5 to preamplifier stage 38. The conductive plate or layer 40 is covered by a dielectric layer 42 in analogy to the explanations given with respect to dielectric covering of conductive plate or layer 34. By contacting the electrolytic conductance body BO of the individual so as to establish the body conductor $7_B$ of FIG. 1, there is again formed a series capacitance 40/42/BO.

Providing the dielectric material layers 36 and/or 42 additionally improves cleanability and prevents electrode corrosion.

It is perfectly clear to the skilled artisan that a capacitive signal coupling as shown in FIG. 6 may also be realised by covering the other conductive plate 30 by a dielectric layer or by covering both conductive plates 30 and 34 by such dielectric layers, thereby establishing a double-layer dielectricum. Thereby, as a very intimate contact of the surfaces establishing a series capacitance coupling should be realized, an electroconductive gel may be applied between these surfaces to be contacted, e.g. a gel as is used or applied to cardiographic electrodes.

Bringing the parts to be contacted into mutual intimate contact so as to establish the series capacitance may be realized in any known way, as by clip-fixation, bayonet fixation etc. Nevertheless, in a most preferred embodiment, this contacting is realized as shown in FIG. 6, by magnetic attraction too.

In FIG. 6 both parts to be contacted are provided with respective magnet arrangements 24*a* and 24*b*. If both these parts are provided with permanent magnets, as shown in FIG. 6, by selection of the respective direction of polarity P one may prevent that the wire $7_W$ may be brought into contact at a predetermined contact area, be it of a hearing device and/or of the electronic unit. With the direction of polarities P selected according to FIG. 6 the two parts are attracted, whereas if the polarity P e.g. at the plug 32 of wire $7_W$ is inverted as shown in dashed lines, it will not be possible to contact the plug 32 to the area as shown in FIG. 6 due to magnetic repulsion.

Instead of establishing a capacitive contact to the individual's body BO as was explained before a conductive contact member may directly be applied and thereby e.g. for improving comfort to the individual especially a conductive member of conductive plastic material, especially of conductive polymer.

Figure 7:
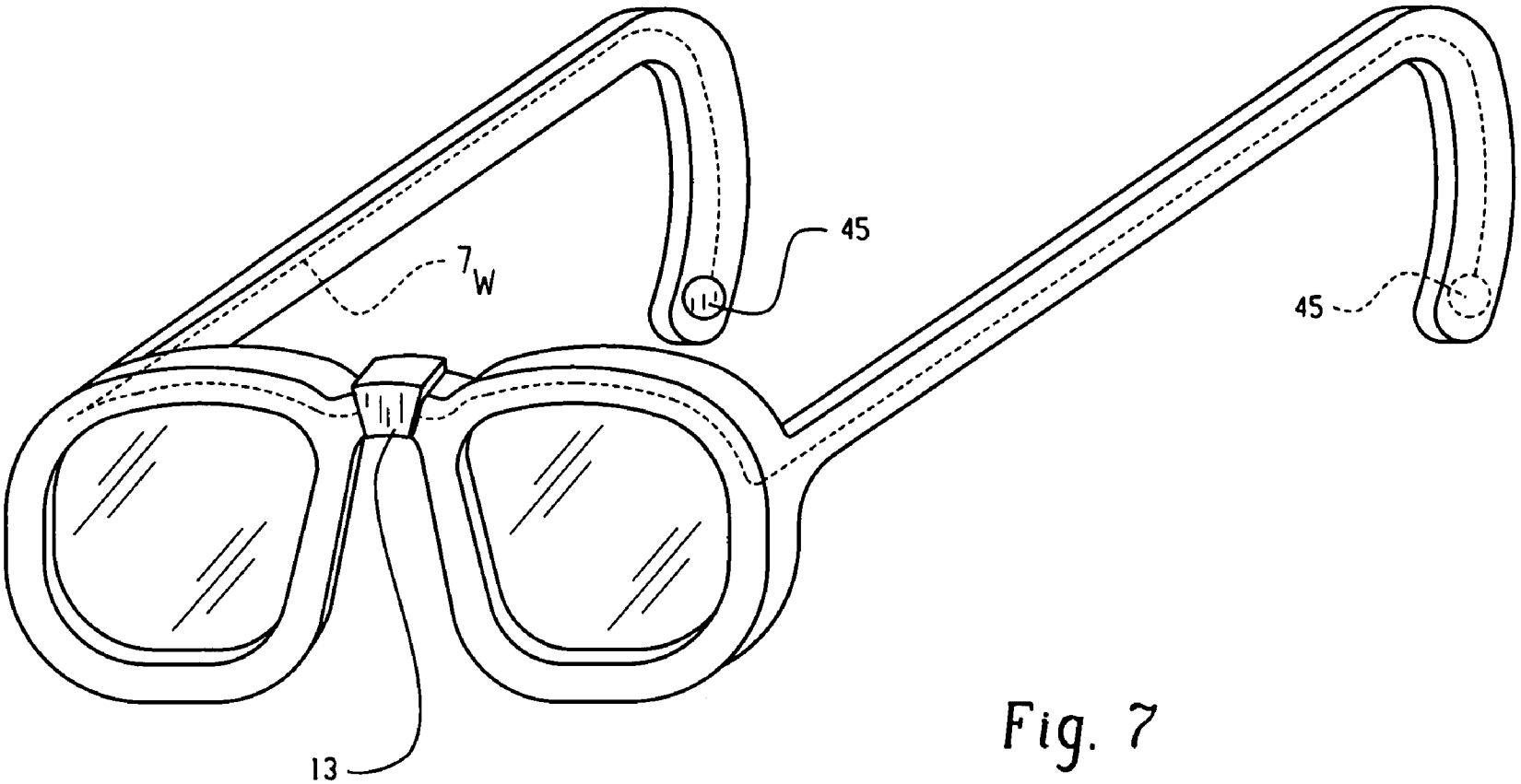

In a further preferred embodiment of the present invention and according to FIG. 7 the wire $7_W$ is integrated into glasses. Thereby, the wire $7_W$ is contacted with the respective right-hand and left-hand hearing devices (not shown in FIG. 6) at schematically shown contact areas 45, which preferably are realized for establishing contact by magnetic attraction, as shown in the FIGS. 4 to 6. If provided, an electronic unit 13 may also be integrated into the glasses. Thus, by simply applying the glasses, the communication link 7 according to the present invention between the binaurally operated hearing devices is established, which is largely facilitated by conceiving contacting at the areas 45 to the respective hearing devices, as was described, by magnetic attraction.

The invention claimed is:

1. A method of establishing a binaural communication link between two hearing devices at an individual by at least two electrical conductors, each of said hearing devices comprising an electrical to mechanical output converter, the method comprising the steps of establishing one of said at least two electrical conductors by the individual's body and a second one of said at least two electrical conductors by a wire.

2. The method of claim 1, further comprising bi-directionally transmitting electrical signals between said hearing devices.

3. The method of claim 1, further comprising transmitting at least one of control signals and of audio signals via said communication link.

4. The method of claim 1, further comprising providing an electronic unit communicating by said link with said devices.

5. The method of claim 4, wherein said unit comprises a receiver-/transmitter-unit for wireless communication and establishing communication.

6. The method of claim 5, further comprising providing said transmitter-/receiver unit between said two hearing devices.

7. The method of claim 1, wherein one of said two hearing devices is a master and the second of said hearing devices is a slave.

8. The method of claim 1, further comprising applying said wire to at least one of said hearing devices by magnetic attraction.

9. The method of claim 8, further comprising establishing by said magnetic attraction an electric conduction contact of said wire to an input tab of said at least one hearing device.

10. The method of claim 8, further comprising establishing by said magnetic attraction a capacitive electric contact of said wire to an input of said at least one hearing device.

11. The method of claim 8, further comprising establishing a predetermined relative positioning of a contact area at said wire and a contact area at said at least one hearing device, by said magnetic attraction.

12. The method of claim 8, further comprising enabling or disabling applying said wire to one of said two hearing devices by appropriately selecting magnetic polarities of respective magnetic arrangements at said at least one hearing device and said wire.

13. The method of claim 9, further comprising establishing said conduction contact by at least one of a magnetic and of a ferromagnetic member.

14. The method of claim 9, further comprising establishing said conduction contact with at least one of a non-magnetic metal contact member, a conductive polymer contact member.

15. The method of claim 1, further comprising establishing electric contact to said individual's body from said devices by a conduction body electrode comprising at least one of a metallic and of a conductive polymer body electrode.

16. The method of claim 1, further comprising establishing electric contact to said individual's body by a series capacitance electrode from said hearing devices.

17. The method of claim 1, further comprising providing an electronic unit interconnected between said two hearing devices by said communication link and providing at said electronic unit an electrode to said individual's body comprising one of a conduction body electrode, preferably of at least one of a metal and of a conductive polymer and of a capacitive body electrode.

18. The method of claim 1, wherein said hearing devices are one of in-the-ear and outside-the-ear hearing devices.

19. The method of claim 1, wherein said hearing devices are therapeutical hearing aid devices.

20. The method of claim 1 further comprising integrating said communication link into a head-worn assembly, preferably into glasses.

21. The method of claim 20, further comprising establishing electric connection of said wire to at least one of said hearing devices by putting on said glasses.

22. A binaural hearing device set comprising a pair of hearing devices and a communication link between said pair of hearing devices, said communication link comprising a pair of body electrodes for establishing an electrically conductive communication path by using the body of an individual wearing said binaural hearing device set as an electrical conductor, and each of said pair of hearing devices comprising an electrical to mechanical output converter, wherein said communication link further comprises at least one single wire.

23. The set of claim 22, further comprising a magnetic-connection arrangement between at least one end of saidwire and at least one of said two hearing devices.

24. The set of claim 23, wherein said magnetic connection comprises conductive contact members at said hearing device and at said one end respectively for establishing mutual galvanic contact between said wire and said hearing device.

25. The set of claim 24, wherein at least one of said conductive contact members comprises a magnet or being made of ferromagnetic metal.

26. The set of claim 24, wherein at least one of said conductive contact members comprises at least one of non-magnetic metal and of conductive polymer.

27. The set of claim 23, wherein said magnetic connection comprises a series capacitance, established by establishing said magnetic connection.

28. The set of claim 22, wherein said communication link further comprises an electronic unit and two single wires respectively connectable to said hearing devices on one side and to said electronic unit on the other side.

29. The set of claim 28, wherein said electronicunit comprises a wireless transmitter-/receiver-unit operationally connected to contact areas for said two wires.

30. The set of claim 22, wherein said body electrode is a conductive plate or a conductive plate covered with a dielectric material.

31. The set of claim 22, wherein said wire is integrated into a head-worn assembly.

32. The set of claim 22, wherein said hearing devices are in-the-ear or outside-the-ear hearing devices.

33. The set claim 22, wherein said hearing devices are hearing aid devices.

* * * * *

UNITED STATES PATENT AND TRADEMARK OFFICE

CERTIFICATE OF CORRECTION

PATENT NO. : 7,254,246 B2
APPLICATION NO. : 10/054479
DATED : August 7, 2007
INVENTOR(S) : Andreas Jakob It is certified that error appears in the above-identified patent and that said Letters Patent is hereby corrected as shown below:

On the Title Page:

Item (63) under Related U.S. Application Data: Please delete "Continuation" and replace with --Continuation-in-part--

Item (56) under References Cited, subtitle "Foreign Patent Documents: Delete the second "WO" before foreign patent reference "01/87014A2"

In the Specifications:

Column 7, line 38: after the word "other." begin a new paragraph beginning with --As will now be shown with the help…--

In the Claims:

Column 10, line 29: Insert a space between the words "said" and "wire";

Column 10, line 50: Insert a space between the words "electronic" and "unit"

Signed and Sealed this

Twenty-fifth Day of December, 2007

Jon W. Dudas

JON W. DUDAS
*Director of the United States Patent and Trademark Office*